United States Patent [19]

Hultsch

[11] 4,184,964

[45] Jan. 22, 1980

[54] CENTRIFUGE

[75] Inventor: Günther Hultsch, Oberschleissheim, Fed. Rep. of Germany

[73] Assignee: Krauss-Maffei AG, Munich, Fed. Rep. of Germany

[21] Appl. No.: 924,715

[22] Filed: Jul. 14, 1978

[30] Foreign Application Priority Data

Aug. 12, 1977 [DE] Fed. Rep. of Germany ..... 2736351

[51] Int. Cl.[2] ..... B01D 33/02

[52] U.S. Cl. ..... 210/365; 210/367

[58] Field of Search ..... 248/26, 280.1, 292.1, 248/296, 297.1, 325, 364; 210/78, 364–367, 325

[56] References Cited

U.S. PATENT DOCUMENTS 2,658,372 11/1953 Kirby ..... 210/365

FOREIGN PATENT DOCUMENTS 1072199 5/1956 Fed. Rep. of Germany .
1198295 4/1966 Fed. Rep. of Germany .
1288990 10/1969 Fed. Rep. of Germany .

*Primary Examiner*—Frank Sever
*Attorney, Agent, or Firm*—Karl F. Ross

[57] ABSTRACT

A wobble centrifuge has a housing in which a tube shaft is rotatable about a first axis, this tube shaft having a lower tube part centered on the first axis and an upper tube part centered on a second axis that crosses the first axis at an intersection. An at least partially flexible core shaft has a lower core part rotatable in the lower tube part about the first axis and an upper core part rotatable in the upper tube part about the second axis. A downwardly flared sieve drum is carried on the upper core part and is centered generally on the second axis, this sieve drum having a wall tapered upwardly from a lower edge spaced below the intersection in a direction parallel to the second axis by a predetermined distance. A suspension to be centrifuged is introduced into the drum generally radially of the axes at a location spaced above the intersection in a direction parallel to the second axis by a spacing equal to substantially more than the spacing between the lower end of the drum and the intersection. The tube shaft is rotated about the first axis and the core shaft parts about the respective axes for advancing the solid phase of the suspension being centrifuged down inside the drum from the introduction location toward the lower edge. The center of gravity of the drum lies offset from this intersection, but imbalance is corrected by providing at least one counterweight on the tube shaft.

10 Claims, 4 Drawing Figures

31
23
19
20
17
18
17
21
42
8
40
45
24
37
12
9
5
36
41
15
28
22
48
10
38
39
32
49
11
2
1
4
3
30
26
50
30
33
16
6
34
51
7
25
14
44
13
35
29
27

CENTRIFUGE

FIELD OF THE INVENTION

The present invention relates to a centrifuge. More particularly, this invention concerns a wobble-type centrifuge.

BACKGROUND OF THE INVENTION

Wobble-type centrifuges normally have a foraminous drum that is mounted on an at least partially flexible core shaft having a lower part lying on a first axis and an upper part lying on a second axis intersecting the first axis at an acute angle. A tube shaft surrounds and journals this core shaft and has lower and upper parts, respectively, centered on the first and second axes. The tube shaft is rotated about the first or lower axis and the core shaft is rotated at a different anuglar speed so that the foraminous drum wobbles or nutates slightly as it rotates. The effect of this operation, as described in German patent publications No. 1,072,199, 1,198,295, 1,288,990, as well as Swiss patent 566,816 and commonly assigned U.S. patent application Ser. No. 884,162 filed Mar. 7, 1978, is that the solid phase of a suspension being centrifuged is caused to move axially along the drum which to this end is given an upward or downward taper. Hereinafter the terms "upper" and "lower" and associated terminology are used purely for convenience's sake, there being no intention to limit the invention to a particular orientation of the parts relative to the vertical.

Three factors normally control the displacement of the solid phase of the suspension being centrifuged:

1. The varying angle of the centrifugal force with respect to the surface of the drum due to the wobbling of the generator.
2. The oscillatory displacement parallel to the rotation axes of the surface of the drum.
3. The Coriolis acceleration perpendicular to the machine axis whose level is proportional to the distance from the intersection of the two rotation axes.

No matter what orientation the machine has relative to the vertical the considerable centrifugal forces are therefore effective to displace the solid phase of the solution from the small end toward the wide end of the drum in the form of a continuously moving filter cake whose depth decreases in the direction of movement. As the thickness of the filter cake decreases, the filtering effect is lessened and the residence time of the solid phase inside the centrifuge decreases, so that the operation is correspondingly less effective at extracting the liquid phase from the suspension. This inefficiency is even greater in the known wobble centrifuges since the distance between the location at which the suspension is fed in and the intersection of the two axes is smaller than the distance between this intersection and the edge of the drum over which the solid phase falls when finally leaving the drum.

OBJECTS OF THE INVENTION

It is therefore an object of the instant invention to provide an improved wobble centrifuge.

Another object is to provide such a centrifuge wherein the Coriolis acceleration is increased in the drum at the input location where the suspension is introduced, and decreased in the drum at the output location.

A further object of the invention is to provide a wobble centrifuge which is capable of operating at higher efficiency, that is by removing more of the liquid phase from the solid phase, than the prior-art centrifuges.

SUMMARY OF THE INVENTION

These objects are attained according to the instant invention in a centrifuge of the above-described general type wherein, however, the filling location is spaced above the intersection of the two axes in a direction parallel to the other or tipped axis by a spacing equal to between about one and one-fifth and three times the distance between the output edge of the drum and this intersection. This construction therefore greatly increases the distance of the filling location from the intersection, so that the centrifugal force is maximized at this location along with the Coriolis acceleration.

As such an increase in the spacing of the filling zone from the axis intersection increases the overall eccentricity of the system, the centrifugal imbalance or throw is thereby also increased. When an increase in the normal spacing of the fill zone from the axis intersection exceeds approximately 30% this imbalance normally cannot be tolerated. To this end the instant invention envisages the use of a counterweight which is secured to the lower tube part of the tube shaft. In order further to increase the smoothness of operation and hence make the machine quiet a second such counterweight is provided diametrically opposite the first counterweight on the upper tube part. The first counterweight is secured to the lower tube part in a location traversed by a plane including both of the axes and to the side of these axes away from which the other or upper axis is tipped relative to the one or lower axis. As the type of suspension being centrifuged can further change the balance on the system, the instant invention also provides for adjustment of the effective masses of the counterweights either by making some displaceable on the tube shaft, or by being able to vary the weight of these bodies. Such weight variation can easily be effected by forming each of the counterweights as a closeable container that can be filled with a liquid whose density or quantity can be varied to achieve different masses for the counterweight.

According to the instant invention the center of gravity of the drum does not lie at the intersection of the two rotation axes, as has been considered absolutely essential hitherto in order to balance the system. According to the invention the center of gravity of the drum itself is moved from the intersection toward the input end of the drum, and this displacement is compensated for by mounting a counterweight not on the drum but on the tube shaft. Such construction increases the operating efficiency of the centrifuge according to this invention and allows the filter cake to be centrifuged so that it is almost completely dry when it finally leaves the drum at the lower or output end.

SPECIFIC DESCRIPTION

Figure 1:
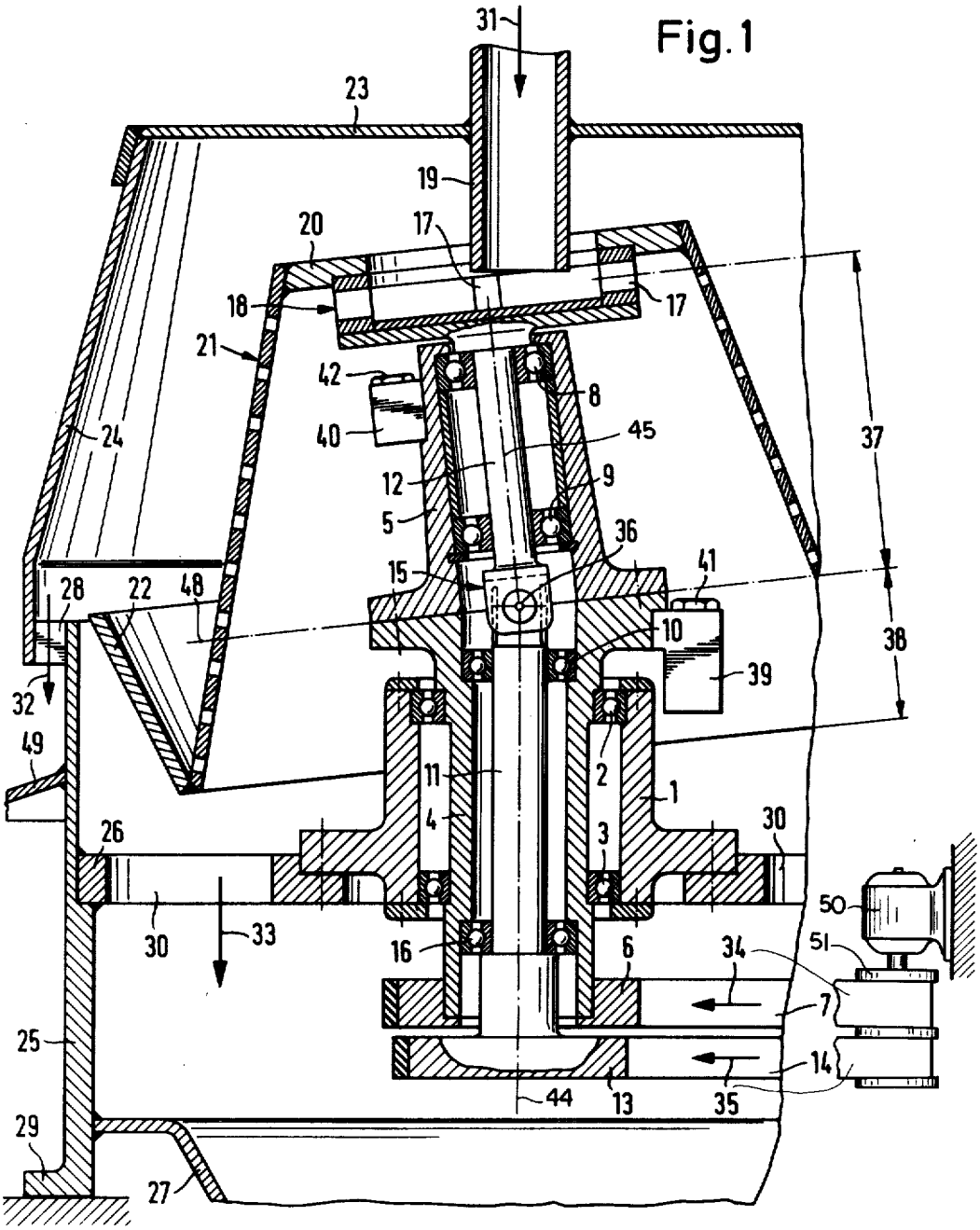
FIG. 1 is a vertical axial section through a centrifuge according to this invention.

As shown in FIG. 1 the apparatus according to the invention has a housing having in turn a hub 1 carrying via roller bearings 2 and 3 a lower tube-shaft part 4 centered on an axis 44 and carrying at its upper end an upper tube-shaft part 5 centered on an axis 45 inclined at an agnel $\alpha$ of between 4° and 8°, here 6°, to the axis 44. A pulley 6 carries a belt 7 reeved over one-half of a drive pulley 51 driven by a motor 50.

Bearings 8 and 9 within the upper tube part 5 and bearings 10 and 16 within the lower-tube part 4 receive respective upper and lower core-shaft parts 12 and 11, respectively, centered on the axes 45 and 44. A pulley 13, over which a belt 14 also connected to the pulley 51 is carried is mounted on the lower part 11 and a universal joint 15 rotationally interconnects the two tube-shaft parts 11 and 12 at the intersection 36 of the axes 44 and 45.

The housing for the centrifuge has a lower side wall 25 supported via feet 29 on the floor or ground and having an upper edge connected via struts 28 to an upper housing part 24 over which is engaged a removable cover 23 provided with an inlet tube 19 centered on the axis 44. An inlet distributor 18 formed with openings or slots 17 directed perpendicular to the axis 45 is fixed to the upper end of the shaft part 12 and carries on its upper end an annular disk or ring 20 from which extends downwardly a frustoconical skirt or drum 21 which is foraminous, here perforated. The drum 21 has a conicity angle of 15°. Extending upwardly from its lower edge is a nonforaminous skirt 22 having the same angle of conicity.

In use the belts 7 and 14 are driven in the same direction as shown by the arrows 34 and 35, but since the pulleys 6 and 13 are of different diameters the tube shafts 4/5 will be rotated about the axis 44 at a slower angular speed than the core shaft 11/12 which rotates inside the tube shaft 4/5 about both of the axes 44 and 45 with corresponding flexing at the joint 15.

A suspension to be centrifuged is fed into the housing through the tube 19 in the direction indicated by arrow 31 to fall into the distributor 18 whence it will be centrifugally ejected outwardly through the holes 17 into the upper end of the drum 21. The apertures in the drum 21 are so small that the solid phase of the suspension cannot pass through them; thus the liquid phase passes radially outwardly, coming against the wall 24 and draining out through the spaces between the struts 28 as shown by arrow 32 to run off over a skirt 49. Even liquid that is ejected below the plane of the upper edge of the lower housing part 25 will be able to exit through the space between the housing parts 24 and 25 as the radial force will cause it to run upwardly on the upwardly flared skirt 22.

Meanwhile the solid phase will work its way downwardly on the inner wall of the drum 21 due to the combined centrifugal force and wobbling movement. This solid phase will eventually fall off the lower edge of the drum and onto a plate 26 that not only serves to support the hub 1 but also is formed with outlet holes 30 through which the solid phase falls in the direction of arrow 33 to be caught by an outlet funnel 27 at the base of the machine. In this manner the liquid and solid phases are separated.

According to the instant invention the inlet location, here defined by the centers of the openings 17, is spaced a distance 37 measured parallel to the axis 45 from the intersection 36 of the axes 44 an 45. On the other hand the outlet or lower edge of the drum 21 is spaced at a distance 38 below this intersection measured in the direction of the axis 45 on which the drum 21 is centered. The distance 37 is greater according to the instant invention than the distance 38 by between 20% and 200%, here equal to approximately 100% more than the distance 38.

The effect of this increase distance between the inlet 17 and the intersection 36 is, of course, an upward displacement of the center of gravity of the drum 21 along the axis 45. This displacement is corrected by provision on the lower-tube part 4 of a counterweight 39 formed as a hollow liquid-containing vessel having a removable cap 41. Diametrically opposite this counterweight which lies in a plane including the axes 44 and 45, but in that angular region where the plane 48 is furthest from a plane perpendicular to the axis 44, is another counterweight 40 having a cap 42. The amount of liquid or type of liquid inside these counterweights 39 and 40 can be adjusted to counteract the imbalance caused by the displacement of the center of gravity of the drum 21 according to this invention. It is also, of course, within the scope of this invention to make the counterweights 39 and 40 movable on the two parts 4 and 5.

Figure 2:
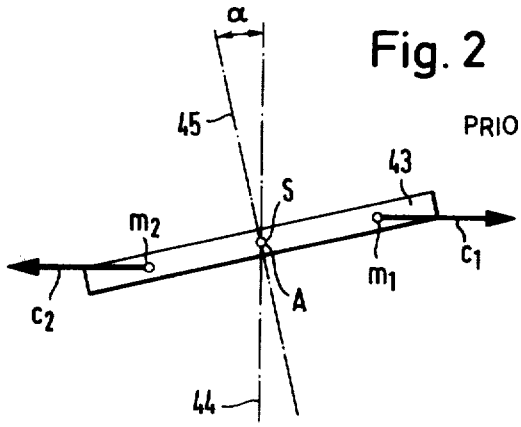
Fig. 2 PRIOR ART
FIG. 2 is a schematic illustration of the forces in a prior-art centrifuge.

More specifically, as shown in FIG. 2, a standard prior-art centrifuge has a drum shown schematically as a disk 43 having a center of gravity S that lies at the intersection A of the axes 44 and 45. The mass of this disk 43 is shown schematically at the points $m_1$ and $m_2$, so that centrifugal forces equal respectively to $c_1$ and $c_2$ are diametrically oppositely effective on the disk 43. Thus this system is balanced since the center of gravity S lies at the intersection of the two axes 44 and 45 inclined to each other by the angle $\alpha$.

Figure 3:
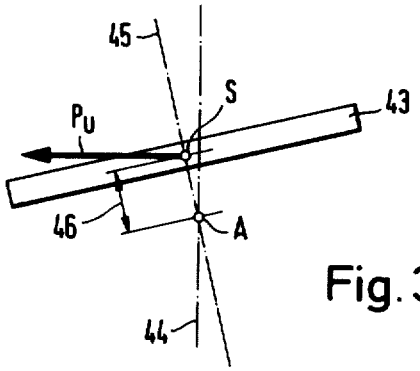
FIG. 3 is a schematic illustration of a modified centrifuge.

When the center of gravity S is moved from the intersection A as shown in FIG. 3 by a distance 46 an eccentric force $P_u$ is effective on the disk 43. As the distance increases so does this force, which is also proportional to the rotation speed. It is apparent that this force can very easily grow to a point where the machine cannot be operated.

Figure 4:
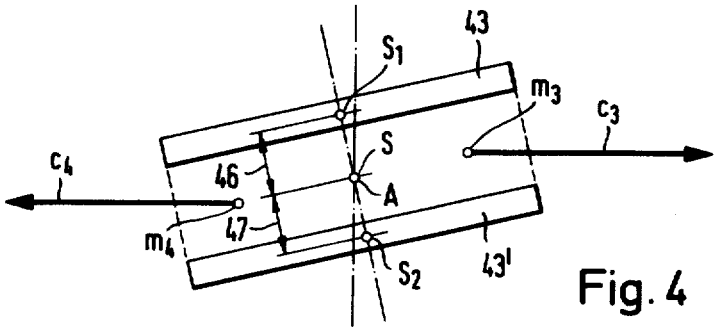
FIG. 4 is a schematic illustration of the centrifuge according to this invention.

According to the instant invention the Coriolis acceleration is maximized for good separation of the solid and liquid phases of the suspension by increasing this distance 46 as much as possible. As shown in FIG. 4 the eccentric force $P_u$ is eliminated. This is done by providing in addition to the parts shown schematically at the disk 43, further parts, constituted by the counterweight 39 in large part, constituting in effect the second disk 43'. This can also, of course, be achieved by increasing the wall thickness of the drum at the output end. Thus when the parts corresponding to the imaginary disks 43 and 43' have the same centrifugal force so as to have respective centers of gravity $S_1$ and $S_2$ spaced the same distances 46 and 47 from the intersection A, the effect will be opposite centers of mass $m_3$ and $m_4$ having oppositely effective centrifugal components $c_3$ and $c_4$. This brings the effective center of gravity S back to the intersection A and therefore results in a completely balanced system, which nonetheless has all of the advantages of a system with a considerable spacing between the introduction location and the center of gravity.

This effect according to the instant invention can be achieved by providing a counterweight on, for instance, the pulley 6, or at any other appropriate location. The counterweight need not be on the drum itself.

I claim:

1. A centrifuge comprising:

a housing;

a tube shaft on said housing having one tube part centered on and rotatable about one axis and another tube part centered on another axis that crosses said one axis at an acute angle at an intersection;

an at least partially flexible core shaft having one core part rotatable in said one tube part about said one axis and another core part rotatable in said other tube part said other axis;

a sieve drum carried on said other core part and centered generally on said other axis, said sieve drum having a lower edge spaced below said intersection in a direction parallel to said other axis by a predetermined distance;

means on said tube shaft for enabling said sieve drum, said other tube part and said other core part to coact to have a center of gravity above said intersection in line with said one axis;

means for introducing a suspension to be centrifuged into said drum generally radially of said axes at a filling location spaced above said intersection in a direction parallel to said other axis by a spacing equal to between about one and one-fifth and three times said predetermined distance; and means for simultaneously rotating said tube shaft about said one axis and said core shaft about both of said axes at different angular speeds for advancing the solid phase of said suspension down inside said drum from said location toward said lower edge.

2. The centrifuge defined in claim 1, wherein said means on said tube shaft for enabling includes a counterweight secured to said one tube part on a plane including both of said axes and to that side of said axes away from which said other axis is tipped relative to said one axis.

3. The centrifuge defined in claim 2, further comprising a second such counterweight on said other tube part diametrically opposite the first-mentioned counterweight.

4. The centrifuge defined in claim 3 wherein said counterweights are of variable mass.

5. The centrifuge defined in claim 4 wherein said counterweights are each formed as a container and each hold a body of liquid, whereby the amount of liquid in said bodies can be changed to vary the mass of said counterweights.

6. The centrifuge defined in claim 1 wherein said means for introducing includes a distributor fixed in said drum and having at least one orifice opening radially of said other axis into said drum at said location.

7. A centrifuge comprising:

a housing;

a tube shaft on said housing having one tube part centered on and rotatable about one axis and another tube part centered on and rotatable about another axis that crosses said one axis at an acute angle at an intersection;

an at least partially flexible core shaft having one core part rotatable in said one tube part about said one axis and another core part rotatable in said other tube part about said other axis;

a sieve drum carried on said other core part and centered generally on said other axis, said sieve drum having a lower edge spaced below said intersection, said sieve drum having a center of gravity lying above said intersection;

means for introducing a suspension to be centrifuged into said drum generally radially of said axes at a filling location spaced above said intersection;

means for rotating said tube shaft about said one axis and said core shaft about both of said axes simultaneously at different angular speeds for advancing the solid phase of said suspension down inside said drum from said filling location toward said lower edge; and a counterweight on and rotatable jointly with said tube shaft and so positioned and constituted as to compensate for the offcenter center of gravity of said drum, and position same above and in line with said one axis.

8. The centrifuge defined in claim 7 wherein said counterweight is carried on said one tube part on a plane including both of said axes and to that side of said axes away from which said other axis is tipped relative to said one axis.

9. The centrifuge defined in claim 8, further comprising a second counterweight on said other tube part diametrically opposite the first-mentioned counterweight, said first counterweight being of greater mass than that necessary to compensate for the offcenter center of gravity of said drum and said second counterweight offsetting this greater mass.

10. The centrifuge defined in claim 9, further comprising means for varying the effective masses of said counter-weights.

* * * * *